US007201145B2

(12) United States Patent
Matsumura

(10) Patent No.: US 7,201,145 B2
(45) Date of Patent: Apr. 10, 2007

(54) FUEL SUPPLY APPARATUS FOR INTERNAL COMBUSTION ENGINE

(75) Inventor: Eriko Matsumura, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 42 days.

(21) Appl. No.: 11/109,775

(22) Filed: Apr. 20, 2005

(65) Prior Publication Data

US 2005/0235958 A1 Oct. 27, 2005

(30) Foreign Application Priority Data

Apr. 21, 2004 (JP) ..... 2004-125376
Apr. 15, 2005 (JP) ..... 2005-118443

(51) Int. Cl.
*F02B 17/00* (2006.01)

(52) U.S. Cl. ..... 123/430; 123/300; 123/446

(58) Field of Classification Search ..... 123/446, 123/299, 300, 431, 304, 491, 575–578, 496
See application file for complete search history.

(56) References Cited

U.S. PATENT DOCUMENTS 5,438,967 A 8/1995 Ito
5,622,152 A * 4/1997 Ishida ..... 123/446
5,893,352 A 4/1999 Fujiwara
6,684,855 B2 * 2/2004 Murakami et al. ..... 123/446
6,959,693 B2 * 11/2005 Oda ..... 123/431
6,978,762 B2 * 12/2005 Mori ..... 123/430
6,981,487 B2 * 1/2006 Ohtani ..... 123/406.37
6,988,490 B2 * 1/2006 Satou ..... 123/480

FOREIGN PATENT DOCUMENTS

DE 197 55 951 A1 12/1998
EP 0 849 455 A2 6/1998
EP 1 132 598 A1 9/2001
JP 2002-364409 12/2002

* cited by examiner

*Primary Examiner*—Carl S. Miller
(74) *Attorney, Agent, or Firm*—Kenyon & Kenyon LLP

(57) ABSTRACT

In a fuel supply apparatus for an internal combustion engine including a first fuel injection valve for directly injecting a fuel into a cylinder and a second fuel injection valve for injecting the fuel into an intake manifold, production of deposits in the first fuel injection valve is prevented and a satisfactory homogenous air-fuel mixture can be formed during homogenous combustion while an engine is at idle. In order to achieve this effect, during homogenous combustion while the engine is idle, a second fuel injection valve injects the fuel and a first fuel injection valve injects the fuel to which pressure has been applied by a low-pressure pump, without a high-pressure pump applying further pressure to the fuel.

3 Claims, 2 Drawing Sheets

FUEL SUPPLY APPARATUS FOR INTERNAL COMBUSTION ENGINE

This nonprovisional application is based on Japanese Patent Applications Nos. 2004-125376 and 2005-118443 filed with the Japan Patent Office on Apr. 21, 2004 and Apr. 15, 2005, respectively, the entire contents of which are hereby incorporated by reference.

BACKGROUND OF THE INVENTION

1. Field of the Invention

The present invention relates to a fuel supply apparatus for an internal combustion engine.

2. Description of the Background Art

An internal combustion engine including a first fuel injection valve directly injecting a fuel into a cylinder for stratified charge combustion and a second fuel injection valve injecting a fuel into an intake manifold for homogenous combustion is known.

When fuel injection from the first fuel injection valve is stopped during homogenous combustion in such an internal combustion engine, there is a possibility that a temperature in an injection hole in the first fuel injection valve opening into the cylinder is raised and deposits are produced into the injection hole to cause clogging of the injection hole. In order to avoid such a problem, it has been proposed that not only the second fuel injection valve but also the first fuel injection valve inject the fuel during homogenous combustion, so as to suppress increase in the temperature in the injection hole of the first fuel injection valve (for example, see Japanese Patent Laying-Open No. 2002-364409).

The fuel injected into the intake manifold by the second fuel injection valve is supplied to the cylinder in an atomized manner along with the intake air. Therefore, as compared with the fuel directly injected into the cylinder by the first fuel injection valve, the fuel injected by the second fuel injection valve is advantageous in forming a satisfactory homogenous air-fuel mixture. Meanwhile, when the fuel is injected into the cylinder in an intake stroke by the first fuel injection valve, the temperature in the cylinder is lowered because of latent heat of vaporization of the fuel. Accordingly, knocking can be suppressed and efficiency in charging intake air can be improved.

Therefore, it is considered that an internal combustion engine that does not carry out stratified charge combustion is provided with the first fuel injection valve for directly injecting the fuel into the cylinder and the second fuel injection valve for injecting the fuel into the intake manifold. When the first fuel injection valve is provided as described above, it is preferable to inject the fuel from the first fuel injection valve in order to suppress increase in the temperature in the injection hole also during an operation state not particularly requiring fuel injection by the first fuel injection valve.

In any internal combustion engine, homogenous combustion is performed while an engine is idle. Here, it is preferable to set a ratio of fuel injection from the second fuel injection valve to be larger such that most fuel is injected from the second fuel injection valve advantageous in forming a satisfactory homogenous air-fuel mixture and that the fuel of a quantity just sufficient for suppressing increase in the temperature in the injection hole is injected from the first fuel injection valve.

For stratified charge combustion, the first fuel injection valve should inject the fuel into the cylinder at a high pressure in compression stroke, and therefore, a high injection pressure is set. Even when stratified charge combustion is not performed, the injection pressure in the first fuel injection valve is set high, in order to promote atomization of the fuel to be injected into the cylinder. Accordingly, in the first fuel injection valve, a minimum fuel injection quantity corresponding to a minimum valve-open time period permitting control of a fuel injection quantity is not made so small. In contrast, combustion temperature is not so high particularly during homogenous combustion while the engine is at idle. Accordingly, injection quantity required to prevent production of deposits in the first fuel injection valve is considerably small, and it is even smaller than the minimum fuel injection quantity of the first fuel injection valve. Then, while the engine is idle, the fuel of a quantity larger than necessary is injected by the first fuel injection valve. In addition, as a quantity of fuel necessary for running the engine is also relatively small, a high ratio of fuel injection by the second fuel injection valve cannot be set, which results in difficulty in forming a satisfactory homogenous air-fuel mixture.

SUMMARY OF THE INVENTION

From the foregoing, an object of the present invention is to provide a fuel supply apparatus for an internal combustion engine including a first fuel injection valve for directly injecting a fuel into a cylinder and a second fuel injection valve for injecting the fuel into an intake manifold, in which production of deposits in the first fuel injection valve is prevented and a satisfactory homogenous air-fuel mixture can be formed during homogenous combustion while an engine is idle.

A fuel supply apparatus for an internal combustion engine according to the present invention includes a first fuel injection valve directly injecting a fuel into a cylinder, to which fuel pressure is applied by a low-pressure pump and further pressure is applied by a high-pressure pump, and a second fuel injection valve injecting the fuel into an intake manifold. During homogenous combustion while an engine is idle, the second fuel injection valve injects the fuel, and the first fuel injection valve injects the fuel to which pressure has been applied by the low-pressure pump, without the high-pressure pump applying further pressure to the fuel.

A fuel supply apparatus for an internal combustion engine according to the present invention includes a first fuel injection valve directly injecting a fuel into a cylinder, to which fuel pressure is applied by a low-pressure pump and further pressure is applied by a high-pressure pump, and a second fuel injection valve injecting a fuel into an intake manifold. While an engine is idle, solely the first fuel injection valve injects the fuel to which pressure has been applied by the low-pressure pump, without the high-pressure pump applying further pressure to the fuel.

A fuel supply apparatus for an internal combustion engine according to the present invention includes a first fuel injection valve directly injecting a fuel into a cylinder, to which fuel pressure is applied by a low-pressure pump and further pressure is applied by a high-pressure pump, and a second fuel injection valve injecting a fuel into an intake manifold. During homogenous combustion while an engine is idle, solely the first fuel injection valve injects the fuel in intake stroke, to which fuel pressure has been applied by the low-pressure pump, without the high-pressure pump applying further pressure to the fuel.

In the fuel supply apparatus for an internal combustion engine according to the present invention, during homogenous combustion while the engine is at idle, the second fuel injection valve injects the fuel and the first fuel injection valve also injects the fuel, so that production of deposits in the first fuel injection valve can be prevented. In addition, the pressure is applied to the fuel injected from the first fuel injection valve not by the high-pressure pump but by the low-pressure pump, so that the injection pressure is low. Therefore, a quantity of the fuel injected by the first fuel injection valve is made not to exceed a quantity of injection required for preventing production of deposits. In addition, a satisfactory homogenous air-fuel mixture can be formed by setting a quantity of fuel injected from the second fuel injection valve to be relatively larger than a quantity of fuel required for homogenous combustion while the engine is at idle.

In the fuel supply apparatus for an internal combustion engine according to the present invention, while the engine is idle, the fuel is injected solely by the first fuel injection valve, without fuel injection by the second fuel injection valve. Therefore, a fuel injection quantity from the first fuel injection valve can be larger (larger than a minimum fuel quantity and larger than minimum fuel for preventing deposits), and prevention of deposits can further be ensured.

In the fuel supply apparatus for an internal combustion engine according to the present invention, during homogenous combustion while the engine is at idle, the fuel is injected solely by the first fuel injection valve in intake stroke, without fuel injection by the second fuel injection valve. Therefore, a fuel injection quantity from the first fuel injection valve can be larger (larger than a minimum fuel quantity and larger than minimum fuel for preventing deposits), and prevention of deposits can further be ensured. In addition, as fuel injection from the first fuel injection valve is performed in the intake stroke, a satisfactory homogenous air-fuel mixture can be formed even when injection from the second fuel injection valve is stopped.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
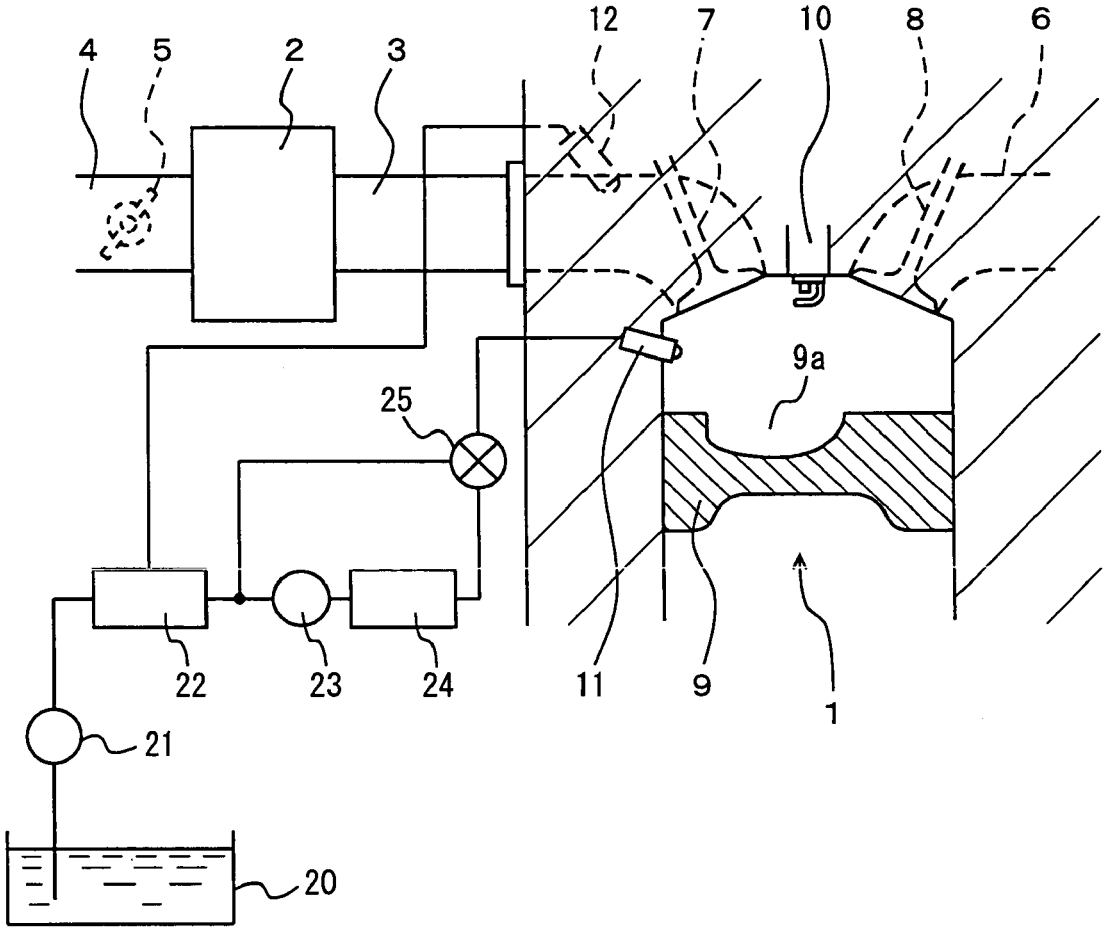
FIG. 1 is a schematic diagram showing an internal combustion engine to which a fuel supply apparatus according to the present invention is attached.

FIG. 1 is a schematic diagram showing an internal combustion engine to which a fuel supply apparatus according to the present invention is attached. In FIG. 1, the internal combustion engine is constituted of an engine body 1, a surge tank 2 used in common to cylinders, an intake manifold 3 connecting between surge tank 2 and each cylinder, and an inlet pipe 4 used in common to the cylinders on a side upstream of surge tank 2. A throttle valve 5 is disposed immediately upstream of surge tank 2 in inlet pipe 4. An exhaust manifold 6 connecting to each cylinder is also provided.

Engine body 1 includes an intake valve 7, an exhaust valve 8, a piston 9, a spark plug 10, a first fuel injection valve 11 for directly injecting the fuel into the cylinder, and a second fuel injection valve 12 disposed in each intake manifold 3.

The present internal combustion engine attains homogenous combustion during all engine operation states, in such a manner that second fuel injection valve 12 injects the fuel in a manner synchronized with air intake (while the intake valve is open) or asynchronous to air intake (prior to opening of the intake valve), so as to supply the atomized fuel to the cylinder along with the intake air. First fuel injection valve 11 is provided in order to lower a temperature in the cylinder by injecting the fuel into the cylinder in intake stroke, so that knocking during low engine speed and high load state is suppressed and efficiency in charging the intake air during high engine speed and high load state is enhanced.

Figure 2:
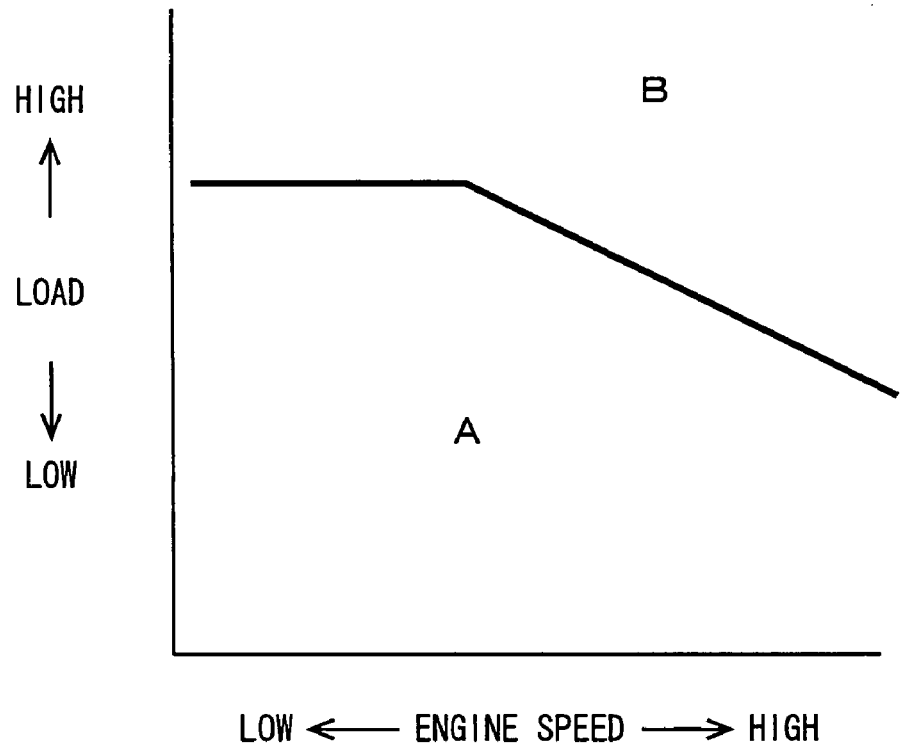
FIG. 2 is a map showing two operation regions A and B based on engine speed and load on the engine.

In an operation region B shown in FIG. 2, a ratio of fuel injection by first fuel injection valve 11 and a ratio of fuel injection by second fuel injection valve 12 to a required fuel quantity are set, for example, to 50% respectively. On the other hand, in an operation region A shown in FIG. 2 including low engine speed and low load state, fuel injection by first fuel injection valve 11 is not particularly necessary for running the engine, and preferably, second fuel injection valve 12 injects all necessary fuel for forming a satisfactory homogenous air-fuel mixture.

First fuel injection valve 11, however, has an injection hole opening into the cylinder. Therefore, when fuel injection is stopped, the temperature in the injection hole is raised and deposits tend to be produced. In a worst case, the injection hole is clogged due to production of deposits. As such, fuel injection should be performed even though it is not necessary for running the engine. In the present internal combustion engine, in operation region A, a ratio of fuel injection from the first and second fuel injection valves to the required fuel quantity is set such that first fuel injection valve 11 injects the fuel in a minimum quantity for preventing production of deposits.

Referring again to FIG. 1, the internal combustion engine includes a fuel tank 20, a low-pressure pump 21 (generally of an electric type), and a low-pressure side accumulator 22 used in common to the cylinders and storing the fuel to which pressure has been applied by low-pressure pump 21. As second fuel injection valve 12 serves to inject the fuel into intake manifold 3, it injects the low-pressure fuel stored in low-pressure side accumulator 22. Meanwhile, first fuel injection valve 11 should promote vaporization by sufficiently atomizing the injected fuel within the cylinder. In order to achieve this, sufficient friction force against the intake air within the cylinder is preferably generated by raising the injection pressure and increasing traveling force of fuel spray. In the present embodiment, a high-pressure pump 23 (generally of a engine-driven type) for further applying pressure to the fuel stored in low-pressure side accumulator 22 is provided. The fuel to which pressure has been applied by high-pressure pump 23 is stored in a high-pressure side accumulator 24 used in common to the cylinders, and first fuel injection valve 11 injects the high-pressure fuel stored in high-pressure side accumulator 24.

In operation region B, the temperature in the cylinder is relatively high. Accordingly, when the high-pressure fuel injected by first fuel injection valve 11 is sufficiently vaporized after being atomized by friction with the intake air, the high-pressure fuel forms a sufficiently homogenous air-fuel mixture together with the fuel in an atomized state supplied to the cylinder by second fuel injection valve 12. Excellent homogenous combustion can thus be realized. Meanwhile, in operation region A as well, vaporization of the high-pressure fuel injected by first fuel injection valve 11 for preventing production of deposits is promoted as a result of atomization by friction with the intake air. Therefore, the high-pressure fuel can form a relatively satisfactory homogenous air-fuel mixture together with the fuel supplied to the cylinder by second fuel injection valve 12.

Figure 3:
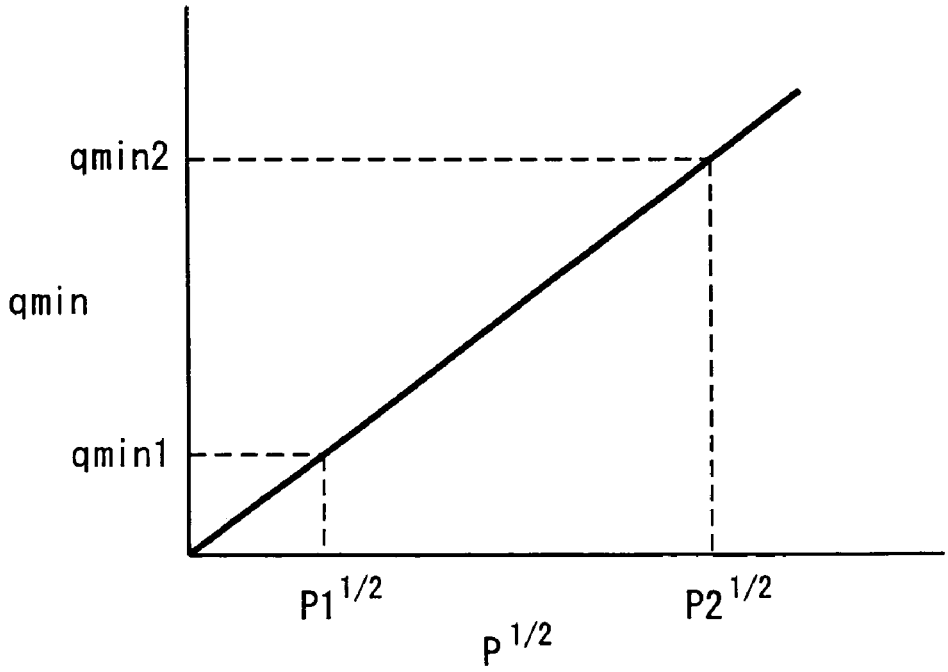
FIG. 3 is a graph showing a relation between 1/2 square of fuel injection pressure and a minimum full injection quantity.

Here, in operation region A, a minimum quantity of fuel required for preventing production of deposits in first fuel injection valve 11 is decreased as the temperature in the cylinder is lower in accordance with a running state of the engine, and attains a smallest value when the engine is idle. Each fuel injection valve has a minimum fuel injection quantity qmin corresponding to the minimum valve-open time period permitting control of the fuel injection quantity. FIG. 3 shows a relation between 1/2 square of fuel injection pressure $P^{1/2}$ and minimum fuel injection quantity qmin for the same minimum valve-open time period. As shown in FIG. 3, minimum fuel injection quantity qmin becomes larger as the fuel injection pressure is higher, and a minimum fuel injection quantity qmin2 when the fuel at a high pressure P2 stored in high-pressure side accumulator 24 is injected is not that small.

As such, a minimum quantity of the fuel required for preventing production of deposits in first fuel injection valve 11 while the engine is idle is smaller than minimum fuel injection quantity qmin2 of first fuel injection valve 11 when the high-pressure fuel is injected. Accordingly, if the high-pressure fuel stored in high-pressure side accumulator 24 is injected by first fuel injection valve 11 while the engine is idle, the fuel of a quantity larger than the minimum quantity of fuel necessary for preventing production of deposits (qmin2) is injected even with the smallest valve-open time period, and the quantity of fuel injection by second fuel injection valve 12 should be decreased. The quantity of fuel required for running the engine is relatively small while the engine is at idle. Therefore, if the quantity of fuel injection by second fuel injection valve 12 is decreased, a ratio of fuel injection by second fuel injection valve 12 advantageous in forming a satisfactory homogenous air-fuel mixture is significantly lowered, which results in deterioration in homogenous combustion at this time.

In order to solve this problem, according to the present embodiment, a switching valve 25 capable of connecting first fuel injection valve 11 to selected one of high-pressure side accumulator 24 and low-pressure side accumulator 22 is provided, so as to cause switching valve 25 to connect first fuel injection valve 11 to low-pressure side accumulator 22 during homogenous combustion while the engine is at idle. In this manner, the fuel at a low pressure P1 stored in low-pressure side accumulator 22 is injected from first fuel injection valve 11 so as to prevent production of deposits while the engine is at idle. Here, a minimum fuel injection quantity qmin1 corresponding to the minimum valve-open time period is considerably smaller than qmin2 described above, as shown in FIG. 3. Therefore, by controlling the valve-open time period, the fuel of the minimum quantity required for preventing production of deposits at that time can appropriately be injected.

As described above, a sufficient quantity of fuel injection by second fuel injection valve 12 advantageous in forming the homogenous air-fuel mixture can be ensured, and excellent homogenous combustion while the engine is idle can be achieved. While the engine is at idle, the operation of high-pressure pump 23 may be stopped. Then, noise produced when high-pressure pump 23 operates can be lowered.

According to the present embodiment, the low-pressure fuel stored in low-pressure side accumulator 22 has been injected by first fuel injection valve 11 while the engine is at idle. In operation region A where the fuel is injected by first fuel injection valve 11 mainly aiming at prevention of production of deposits, in order to appropriately and reliably inject the fuel of a quantity required for preventing production of deposits also during a period other than the engine idle period, first fuel injection valve 11 may naturally inject the low-pressure fuel stored in low-pressure side accumulator 22. Lowering in the pressure of fuel injection by first fuel injection valve 11 is disadvantageous in atomizing the injected fuel, however, adhesion of the injected fuel as a liquid fuel onto a top surface of the piston due to collision therewith can be suppressed, and a quantity of resultant unburned fuel to be exhausted can be reduced.

According to the present embodiment, though internal combustion engine 1 has been described as attaining homogenous combustion in all the engine operation states, the present invention is not limited thereto. For example, so long as an engine performs homogenous combustion while it is at idle, the engine may attain not homogenous combustion but stratified charge combustion in a low-load operation region other than the engine idle period, for example. During stratified charge combustion, first fuel injection valve 11 injects the high-pressure fuel stored in high-pressure side accumulator 24 into the cylinder at high pressure in a latter half of the compression stroke. The fuel thus injected forms a combustible air-fuel mixture in the vicinity of spark plug 10, directly or by being guided to an area in the vicinity of spark plug 10 by a cavity 9*a* formed in the top surface of piston 9.

<Variation>

In the embodiment described above, while the engine is at idle, first fuel injection valve 11 injects the low-pressure fuel stored in low-pressure side accumulator 22 and second fuel injection valve 12 also injects the fuel. In the present variation, the fuel is injected in the following manner.

In the present variation, while the engine is at idle, first fuel injection valve 11 injects the low-pressure fuel stored in low-pressure side accumulator 22, however, second fuel injection valve 12 does not inject the fuel. That is, fuel injection from second fuel injection valve 12 advantageous in forming a satisfactory homogenous air-fuel mixture is stopped. Here, in order to form a homogenous air-fuel mixture, timing of fuel injection from first fuel injection valve 11 may be set to be within the intake stroke.

As the fuel is not injected from second fuel injection valve 12, a total quantity of fuel required while the engine is at idle can be injected from first fuel injection valve 11. Therefore, the fuel of a quantity reliably larger than the minimum fuel quantity required for preventing deposits in first fuel injection valve 11 can be injected while the engine is at idle. Accordingly, the injection hole can sufficiently be cooled and production of deposits can be avoided.

Here, the pressure of the fuel supplied to first fuel injection valve 11 is set as high as the fuel pressure at second fuel injection valve 12, that is, set to 200 kPa to 600 kPa.

While the engine is at idle, as in the embodiment described above, first fuel injection valve 11 is connected to low-pressure side accumulator 22 by means of switching valve 25. Actuation of high-pressure pump 23 may be stopped, so as to lower noise caused by actuation of high-pressure pump 23.

In the schematic diagram shown in FIG. 1, though switching valve 25 is provided to connect first fuel injection valve 11 to low-pressure side accumulator 22 during homogenous combustion while the engine is at idle, the present invention is not limited to such a configuration. In general, in high-pressure pump 23 driven by the engine, the fuel is introduced (suctioned) when the pump plunger is being lowered by the cam driven by the engine and the electromagnetic spill valve is open. High-pressure pump 23 controls the quantity of fuel discharged therefrom by modifying timing of closing the electromagnetic spill valve when the pump plunger is being elevated by the cam. As the timing of closing the electromagnetic spill valve in pressurization stroke during which the pump plunger is being elevated is earlier, a larger quantity of fuel is discharged. In contrast, as the timing is later, a smaller quantity of fuel is discharged. Here, drive duty of the electromagnetic spill valve when a largest quantity of fuel is discharged is assumed as 100%, and drive duty of the electromagnetic spill valve when a smallest quantity of fuel is discharged is assumed as 0%. If the drive duty of the electromagnetic spill valve is 0%, the electromagnetic spill valve is not closed but remains open. That is, so long as the cam continues to rotate (so long as the engine continues to rotate), the pump plunger makes sliding movement in an up-down direction. The electromagnetic spill valve, however, is not closed, and pressure is not applied to the fuel. Therefore, during homogenous combustion while the engine is at idle, the drive duty of the electromagnetic spill valve is set to 0% so as not to apply pressure to the fuel, whereby the low-pressure fuel can be supplied to first fuel injection valve 11. In this manner, it is not necessary to provide a pipe bypassing switching valve 25 or high-pressure pump 23 and high-pressure side accumulator 24. In addition, as high pressure is not generated, sound caused by actuation of high-pressure pump 23 can be lowered.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuel supply apparatus for an internal combustion engine, comprising:

a first fuel injection valve to directly inject a fuel into a cylinder;

a low-pressure pump to apply fuel pressure to the first fuel injection valve;

a high-pressure pump to apply further fuel pressure to the first fuel injection valve; and a second fuel injection valve to inject a fuel into an intake manifold; wherein responsive to an engine operating state, said second fuel injection valve injects the fuel, and said first fuel injection valve injects the fuel to which pressure has been applied by the low-pressure pump, without the high-pressure pump applying further pressure to the fuel.

2. A fuel supply apparatus for an internal combustion engine, comprising:

a first fuel injection valve to directly inject a fuel into a cylinder;

a low-pressure pump to apply fuel pressure to the first fuel injection valve;

a high-pressure pump to apply further fuel pressure to the first fuel injection value; and a second fuel injection valve to inject a fuel into an intake manifold; wherein responsive to an engine operating state, solely said first fuel injection valve injects the fuel to which pressure has been applied by the low-pressure pump, without the high-pressure pump applying further pressure to the fuel.

3. A fuel supply apparatus for an internal combustion engine, comprising:

a first fuel injection valve to directly inject a fuel into a cylinder;

a low-pressure pump to apply fuel pressure to the first fuel injection valve;

a high-pressure pump to apply further fuel pressure to the first fuel injection value; and a second fuel injection valve to inject a fuel into an intake manifold; wherein responsive to an engine operating state, solely said first fuel injection valve injects the fuel in an intake stroke, to which fuel pressure has been applied by the low-pressure pump, without the high-pressure pump applying further pressure to the fuel.

* * * * *